US011006231B1

(12) United States Patent
Parker

(10) Patent No.: US 11,006,231 B1
(45) Date of Patent: May 11, 2021

(54) VOICE AMPLIFICATION APPARATUS FOR PERSONAL PROTECTIVE EQUIPMENT

(71) Applicant: April Parker, Long Beach, CA (US)

(72) Inventor: April Parker, Long Beach, CA (US)

( * ) Notice: Subject to any disclaimer, the term of this patent is extended or adjusted under 35 U.S.C. 154(b) by 0 days.

(21) Appl. No.: 17/033,868

(22) Filed: Sep. 27, 2020

(51) Int. Cl.
*H04R 27/04* (2006.01)
*H04R 1/08* (2006.01)

(52) U.S. Cl.
CPC ..... *H04R 27/04* (2013.01); *H04R 1/083* (2013.01); *H04R 2420/07* (2013.01)

(58) Field of Classification Search
CPC ..... H04R 27/04; H04R 1/08; H04R 1/083; H04R 2420/07
USPC ..... 381/75
See application file for complete search history.

(56) References Cited

U.S. PATENT DOCUMENTS

| | | | | |
|---|---|---|---|---|
| 5,463,693 | A | 10/1995 | Birli et al. | |
| 7,457,427 | B2 | 11/2008 | Birli et al. | |
| 8,340,311 | B2 | 12/2012 | Villarreal, Jr. | |
| 2016/0021472 | A1* | 1/2016 | Wheatley | H04R 5/02 381/75 |
| 2020/0204895 | A1* | 6/2020 | Wendling | A61M 16/0858 |

FOREIGN PATENT DOCUMENTS

KR 100326132 B1 7/2002

OTHER PUBLICATIONS

Thomsen, Japanese researchers create a 'smart' mask to protect against COVID-19, with a built-in speaker and software that can translate speech into eight different languages, MailOnline, Jun. 29, 2020, https://www.dailymail.co.uk/sciencetech/article-8472109/Researchers-create-smart-mask-COVID-19-speaker-translation-software.html.

* cited by examiner

*Primary Examiner* — Paul Kim
(74) *Attorney, Agent, or Firm* — Christopher Pilling

(57) ABSTRACT

A voice amplification apparatus is provided and configured to attach to a portion of a personal protective equipment (PPE) device such that the apparatus is hands-free and in close proximity to a user's mouth. The voice amplification apparatus comprises a speaker and microphone in various positions, wherein the microphone is configured to capture the user's voice which is amplified and projected out of the speaker. In this way, the user can be clearly heard by those in proximity to the user. Advantageously, the usefulness of the apparatus will prevent users from lowering their PPE to communicate which poses a safety hazard during a pandemic, such as COVID-19.

1 Claim, 7 Drawing Sheets

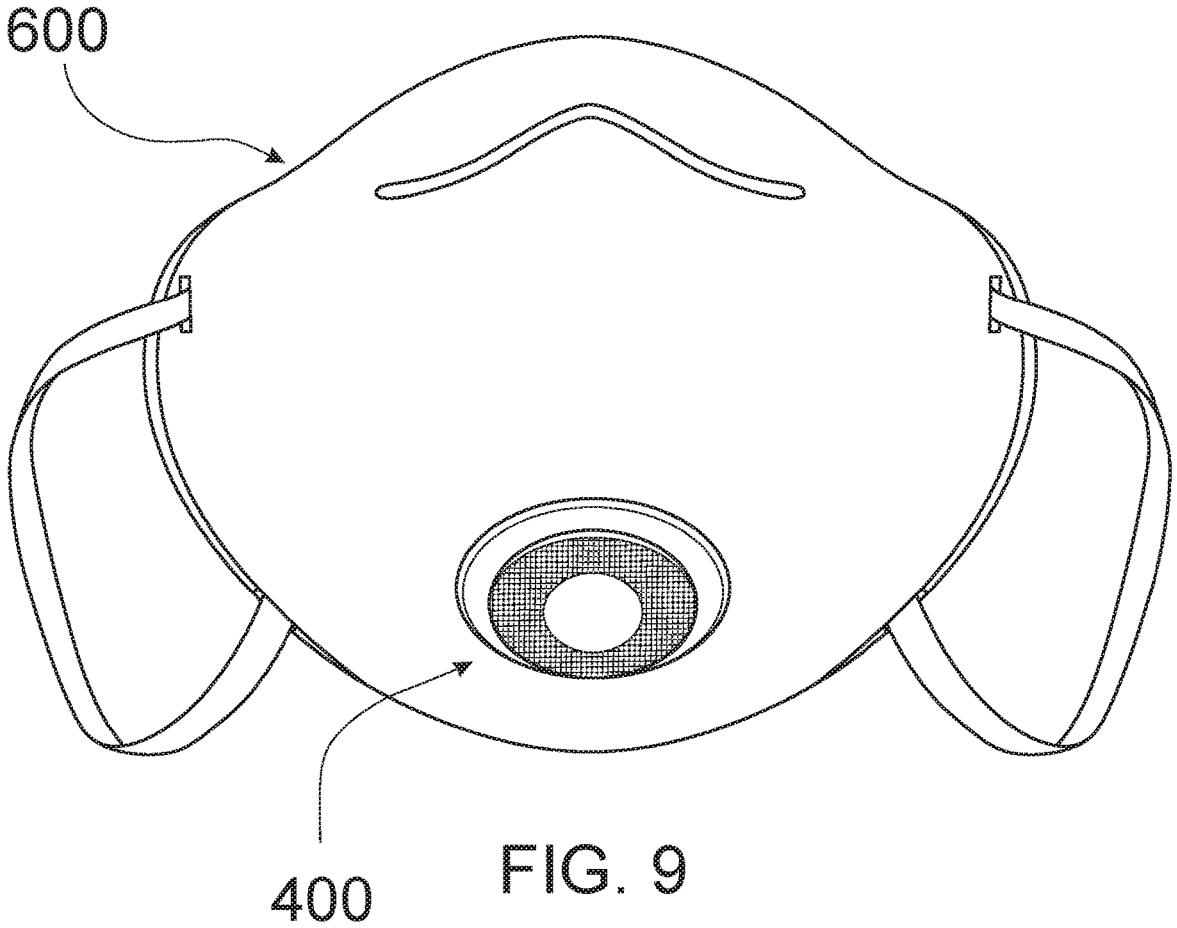
FIG. 9
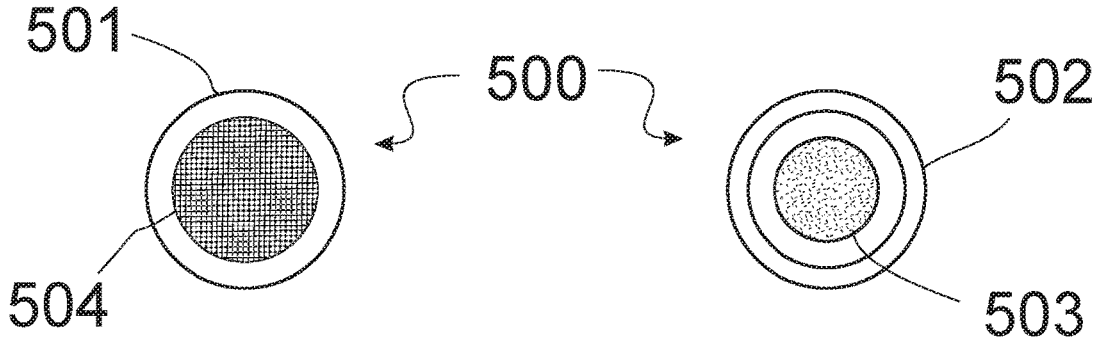
FIG. 10
FIG. 11

VOICE AMPLIFICATION APPARATUS FOR PERSONAL PROTECTIVE EQUIPMENT

CROSS-REFERENCE TO RELATED APPLICATIONS

N/A

BACKGROUND OF THE INVENTION

1. Field of the Invention

The present invention relates generally to voice amplification but more particularly to a voice amplification apparatus for personal protective equipment.

2. Description of Related Art

During a pandemic or other instances of diseases, poor air quality, immune comprised individuals, the use of personal protective equipment (PPE) is required for the safety of the wearer and other persons in proximity to the wearer. PPE may include a variety of equipment, but for the purposes of the present invention, the focus is on facial coverings, such as face masks, shields, or similar protective equipment. Currently, there is a communication issue for persons wearing PPE. More specifically, it is hard to hear a wearer of PPE, due to the sound muffling the PPE provides. Consequently, a solution to this problem is provided herein.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, a voice amplification apparatus for personal protective equipment is provided, comprising a speaker; a PCB; a battery; a microphone, wherein the microphone is configured to receive a user's voice such that it is amplified and projected via the speaker; a volume control member configured to adjust the volume of the amplified voice, and, wherein the apparatus is configured to attach to a personal protective equipment device covering the user's face.

In one embodiment, an enclosed case configured to hold the speaker, the PCB, and the battery is provided. In one embodiment, a clip having a distal end and a proximal end is provided, wherein the proximal end is attached to the enclosed case, and the distal end comprises the microphone. In another embodiment, the clip is configured to attach the voice amplification apparatus to a personal protective equipment device covering the user's mouth. In one embodiment, the voice amplification apparatus is comprised of a first portion and a second portion, wherein the first portion comprises the speaker and second portion comprises the microphone. In one embodiment, the first portion comprises a first magnet and the second portion comprises a segment magnet. In yet another embodiment, the first portion is configured to be positioned on an outside portion of a personal protective equipment device, and the second portion is configured to be positioned on an inside portion of the personal protective equipment device, wherein the first magnet is configured to attach to the second magnet through the personal protective equipment device securing the voice amplification apparatus in position. In one embodiment, the personal protective equipment device is a surgical mask, facial covering, or face shield, or respirator. In another embodiment, the apparatus is built into a personal protective equipment device.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which:

FIG. 9 is a front perspective view of the alternative voice amplification apparatus installed on personal protective equipment according to an embodiment of the present invention.

FIG. 10 is a front view of a microphone portion of the alternative voice amplification apparatus according to an embodiment of the present invention.

FIG. 11 is a rear view of the microphone portion of the alternative voice amplification apparatus according to an embodiment of the present invention.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a voice amplification apparatus for personal protective equipment.

Figure 1:
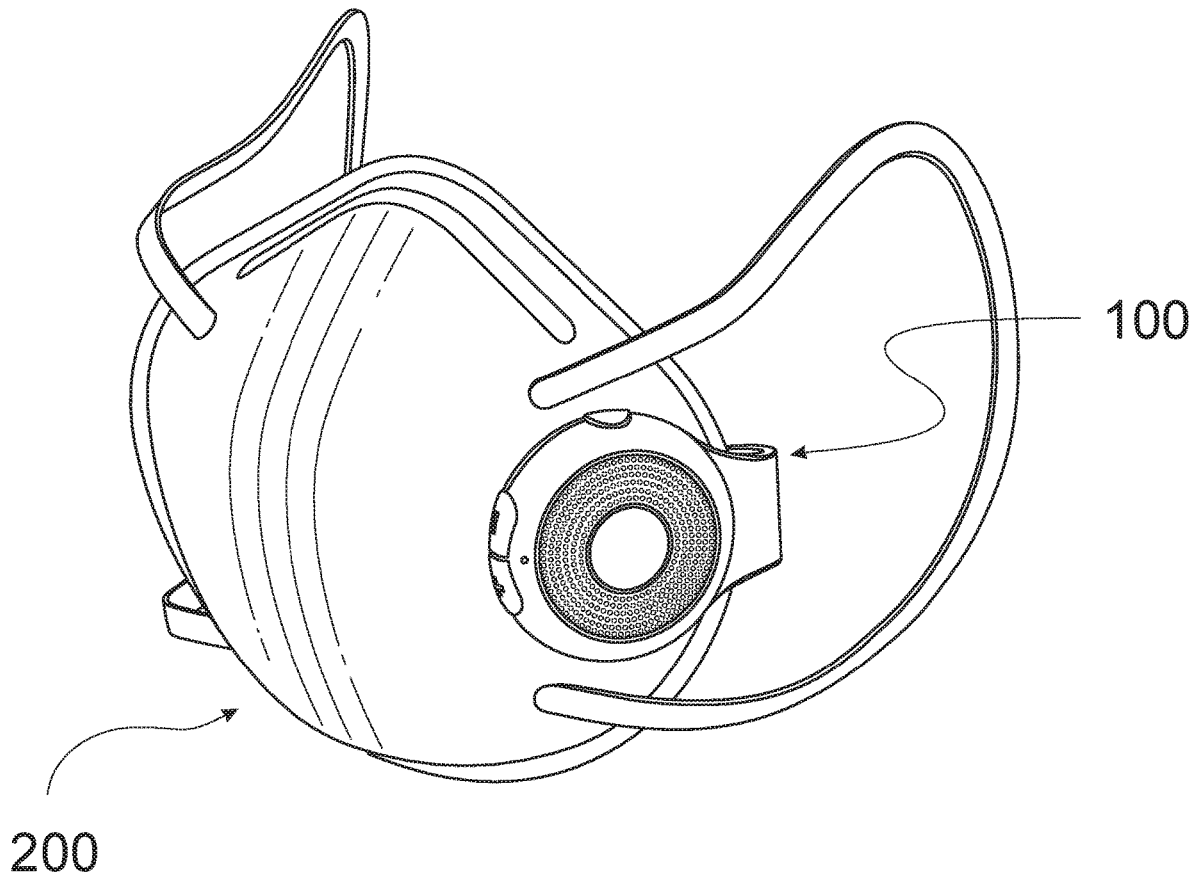
FIG. 1 is a front perspective view of a voice amplification apparatus installed on personal protective equipment according to an embodiment of the present invention.
Figure 2:
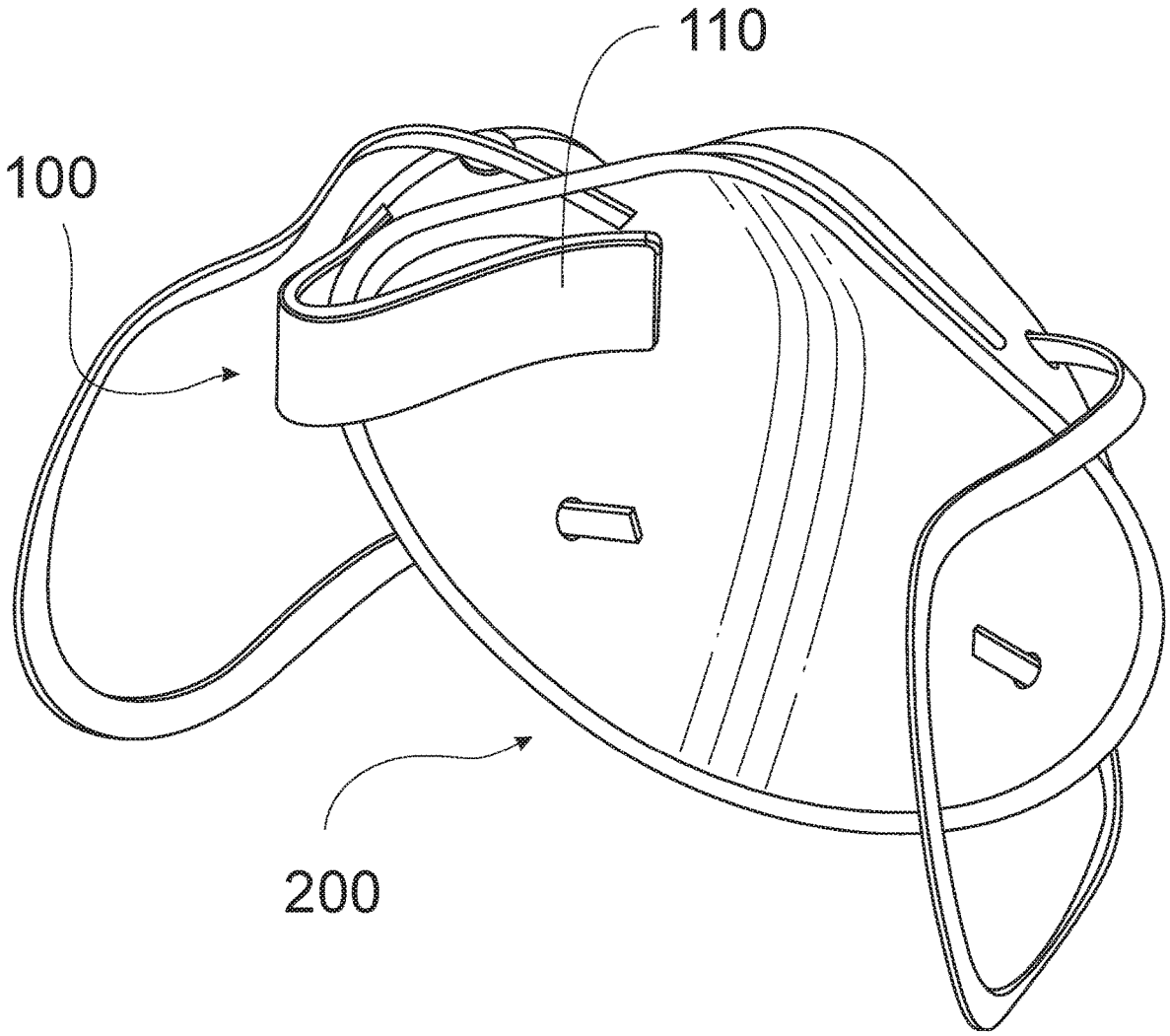
FIG. 2 is a rear perspective view of a voice amplification apparatus installed on personal protective equipment according to an embodiment of the present invention.
Figure 3:
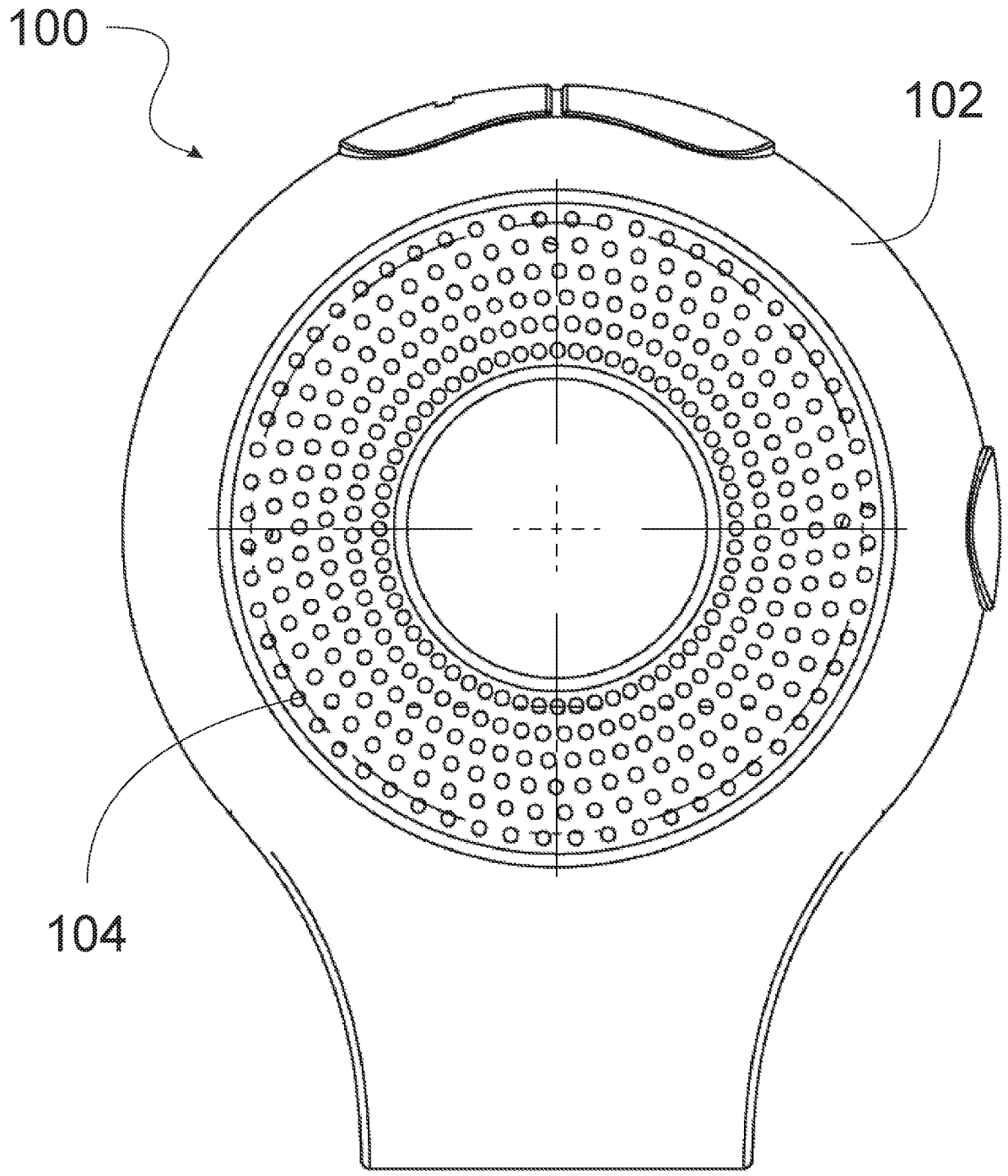
FIG. 3 is a front view of the voice amplification apparatus according to an embodiment of the present invention.
Figure 4:
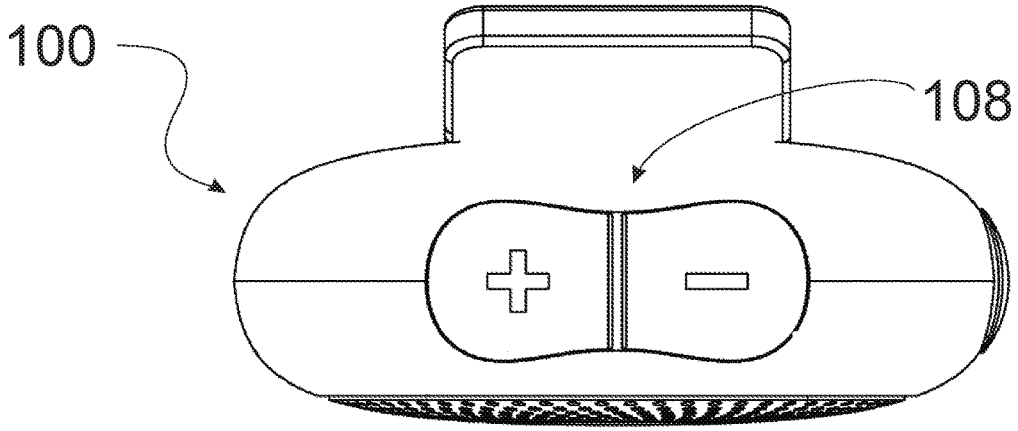
FIG. 4 is a top view of the voice amplification apparatus according to an embodiment of the present invention.

FIGS. 1-2 are various perspective views of a voice amplification apparatus 100 installed on personal protective equipment 200 according to an embodiment of the present invention. Referring now to FIGS. 1-2, the voice amplification apparatus 100 is installed on personal protective equipment 200. In one embodiment, the personal protective equipment (PPE) is a face mask, such as a disposable N95 mask, KN95 mask, cloth mask, fabric mask, polyester mask, spandex mask, or similar mask made from any materials known in the art. In this particular embodiment, the PPE illustrated is a surgical mask. In one embodiment, the voice amplification apparatus 100 of the present invention is configured to attach to a portion of the PPE such that the device is hands-free and in close proximity to a user's mouth. In one embodiment, the voice amplification apparatus 100 is configured to clip onto the PPE. This will be described in more detail below.

Referring now to FIGS. 3-5B, various views of the voice amplification apparatus 100 are illustrated. In one embodiment, the voice amplification apparatus comprises an enclosed case 102 configured to hold the electrical components necessary to operate the apparatus 100, including but not limited to printed circuit board (PCB) 101, microphones, transducers, amplifiers, capacitors, power supply units (battery), electrical wires, speaker components, or any other electrical equipment necessary to carry out the invention. In some embodiments, the enclosed case is circular in shape, however, it is understood that the shape may vary, including but not limited to oval, square, rectangular, etc. The size and shape may be determined by the selected components housed in the enclosed case 102.

In one embodiment, a speaker 104 is positioned on the front portion of the enclosed case, wherein the speaker 104 is positioned such that the sound configured to be broadcasted from the speaker is in the direction of nearby people to the user. That is, the speaker 104 is positioned on the outside of the PPE when the apparatus 100 is attached the PPE, as illustrated in FIG. 1. Also positioned on the outside of the enclosed case 102 is a power switch 106 configured to turn the apparatus 100 on and off, and volume control buttons 108 configured to control the loudness, i.e. the amplitude of the sound wave produced via the speaker 104.

Figure 5A:
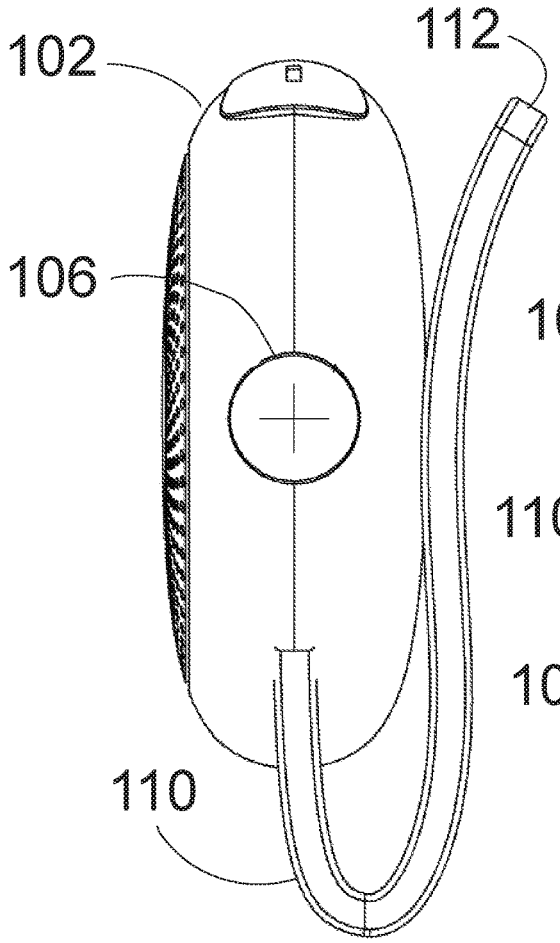
FIG. 5A is a side view of the voice amplification apparatus according to an embodiment of the present invention.
Figure 5B:
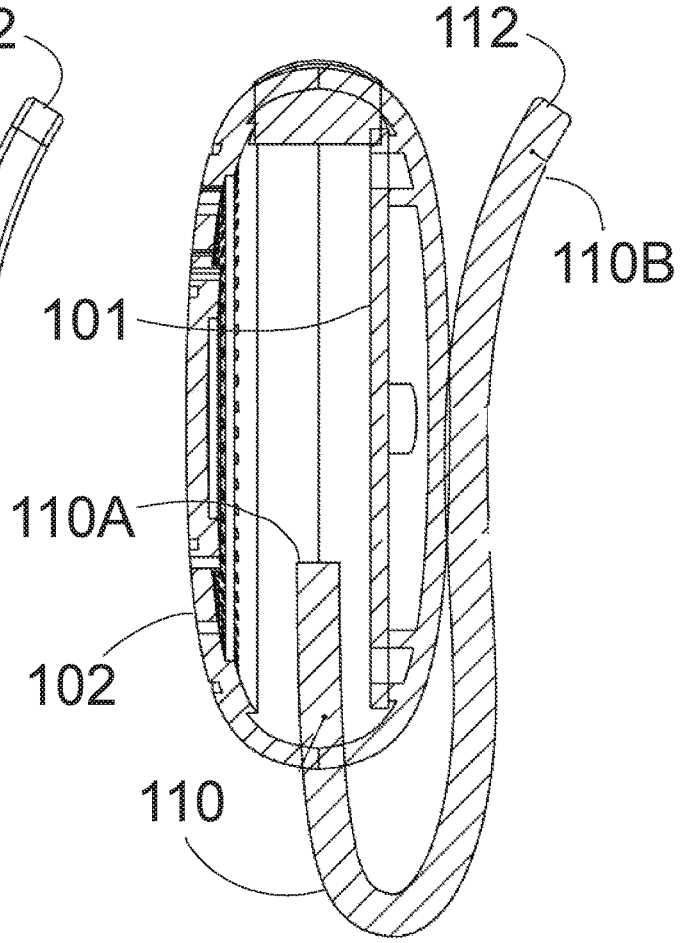
FIG. 5B is a section view of FIG. 5A.
Figure 6:
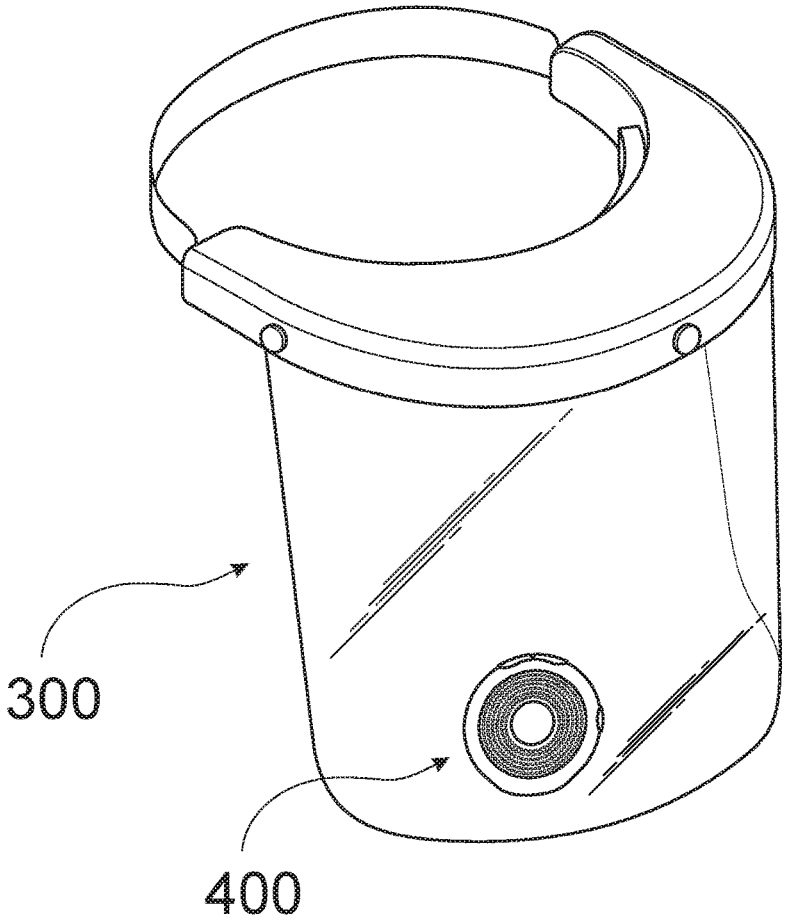
FIG. 6 is a front perspective view of an alternative voice amplification apparatus installed on personal protective equipment according to an embodiment of the present invention.
Figure 7:
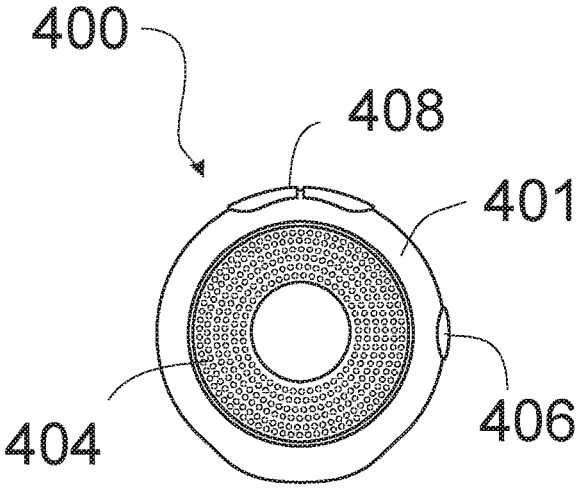
FIG. 7 is a front view of a speaker portion of the alternative voice amplification apparatus according to an embodiment of the present invention.
Figure 8:
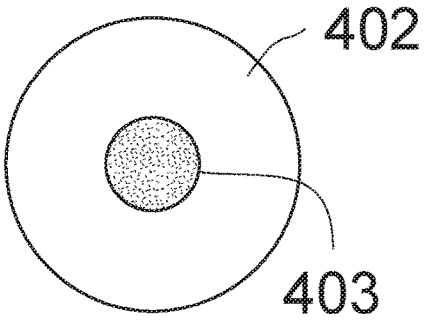
FIG. 8 is a rear view of the speaker portion of the alternative voice amplification apparatus according to an embodiment of the present invention.

Best seen in FIGS. 5A-B, a clip 110 is provided on a bottom portion of the enclosed case 102, wherein the clip 110 extends to a back portion of the enclosed case 102. The clip 110 is configured to be used to attach the apparatus 100 to the PPE (as illustrated in FIG. 2). The clip has a proximal end 110A and a distal end 110B. The clip 110 may be used to attach to the user's clothing when not in use, or the apparatus may be carried by the user in a pocket, purse, bag, or similar holding area due to the limited size of the apparatus.

In one embodiment, a microphone 112 is embedded into the distal end 110B of the clip 110. In one embodiment, the distal end is configured to come under the PPE towards the inner surface (rear surface) of the PPE (as illustrated in FIG. 2), such that the distal end 110B of the clip 110 is proximate to the user's mouth. The microphone 112 is connected to the PCB 101 via wiring embedded into the body of the clip 110.

During use, the user's voice captured via the microphone 112 is amplified and projected out of the speaker 104 on the front portion of the enclosed case 102. In this way, the user can be clearly heard by those in proximity to the user. Advantageously, the usefulness of the apparatus will prevent users from lowering their PPE to communicate which poses a safety hazard during a pandemic, such as COVID-19.

FIGS. 6-11 illustrate an alternative voice amplification apparatus 400 installed on various personal protective equipment 300/600. Referring now to FIGS. 6-11, the apparatus comprises a speaker portion 400 and a microphone portion 500. The speaker portion includes a front side 401 and a rear side 402. In one embodiment, the front side 401 of the speaker portion 400 includes a speaker 404, power switch/button 406, and volume controls 408. These components function similarly as previously described above. In one embodiment, the rear side 402 of the speaker portion 400 includes a first magnet 403. Likewise, the microphone portion 500 includes a front side 501 and a rear side 502. In one embodiment, the front side 501 comprises a microphone receiver 504. In one embodiment, the rear side 502 comprises a second magnet 503. In some embodiments, the magnets are centrally positioned in their respective rear side.

During installation, the first magnet 403 and the second magnet 504 are configured to magnetically attach such that the speaker portion and microphone portion are magnetically attached on both sides of the PPE. The speaker portion is on the front side of the PPE, while the microphone portion is on the rear side of the PPE. The alternative voice amplification apparatus is useful on PPE that has certain requirements, such as medial requirements or physical requirements, when the clip feature on apparatus 100 is not appropriate or possible. In the illustrated embodiment shown in FIG. 6, the PPE 300 is a face shield. In the illustrated embodiment shown in FIG. 9, the PPE 600 is a respirator. During operation, the user's voice is received via the microphone receiver 504 and amplified via speaker 404. The voice is transferred as an audio signal via the magnetic field. The apparatus is powered and operated with an internal battery and PCB.

Figure 12:
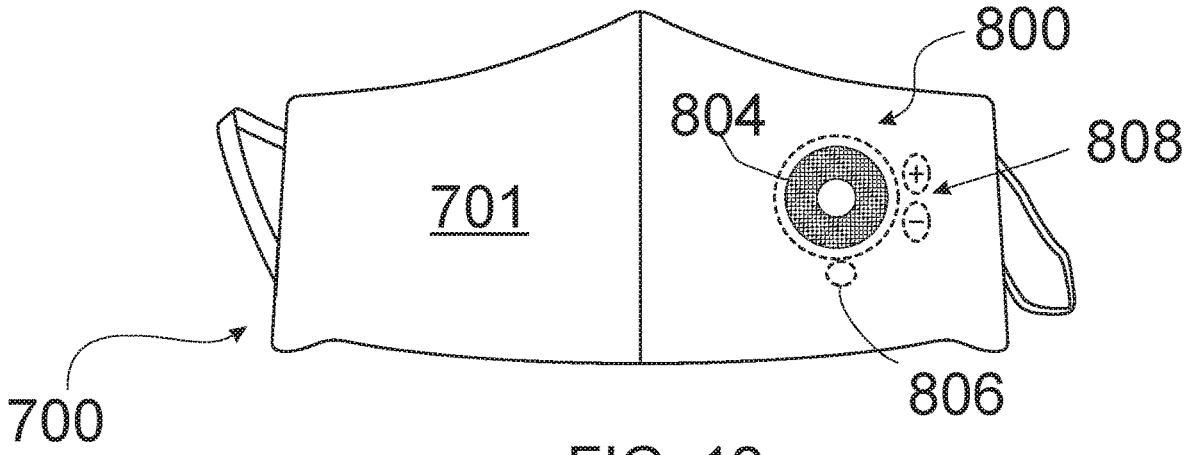
FIG. 12 is a second alternative voice amplification apparatus installed on a first layer of personal protective equipment.
Figure 13:
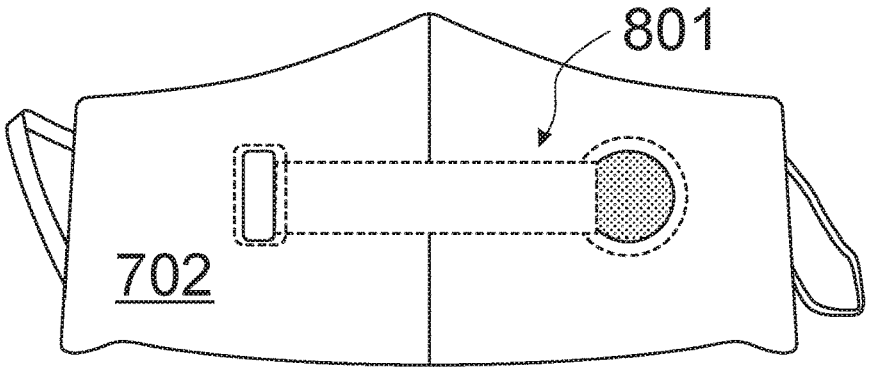
FIG. 13 is the second alternative voice amplification apparatus installed on a second layer of personal protective equipment.
Figure 14:
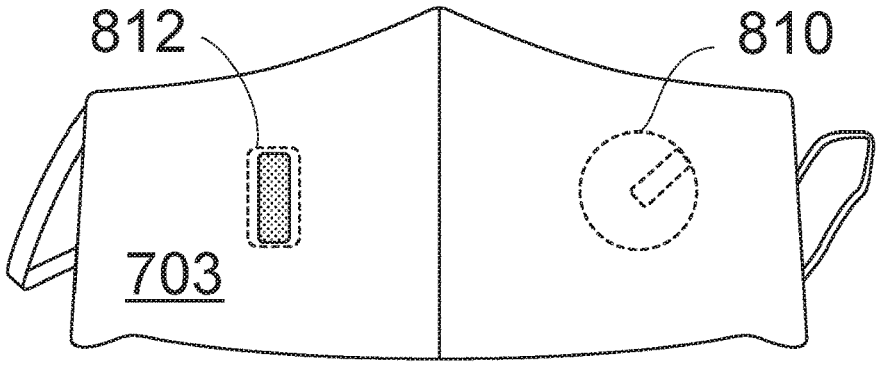
FIG. 14 is the second alternative voice amplification apparatus installed on a third layer of personal protective equipment.

FIGS. 12-14 illustrate a second alternative voice amplification apparatus 800 installed on various layers of personal protective equipment 700. Referring now to FIG. 12, the front layer 701 of the PPE 700 is illustrated. In one embodiment, the PPE 700 is a pliable, flexible face mask, such as a cloth mask. In this layer, a speaker 804, power control 806, and volume controls 808 of the apparatus 800 are built into the front layer 701 of the PPE. Referring now to FIG. 13, internal layer 702 is illustrated. This layer is not visible to the user, and the internal electrical components 801 are built into the layer. The internal electrical components include the PCB, battery, wiring, etc. Referring now to FIG. 14, the rear layer 703 is illustrated. In this layer, the microphone 812 and USB charging port 810 are provided. The USB charging port enables the user to charge the internal battery as well known in the art. In this embodiment, the apparatus functions as the previously described. This embodiment differs in that it is built directly into the PPE; there is no need for installation requirements on the user's part. Advantageously, the apparatus is available at all times and doesn't need to be clipped or attached onto the PPE. All three described embodiments offer unique advantages depending on user needs and the specific PPE selected.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated and can be made without departing from the spirit and scope of the invention.

It should further be noted that throughout the entire disclosure, the labels such as left, right, front, back, top, bottom, forward, reverse, clockwise, counterclockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A voice amplification apparatus for personal protective equipment comprising:

an enclosed case;

a speaker positioned in the enclosed case;

a PCB positioned in the enclosed case;

a battery positioned in the enclosed case;

a clip configured to attach the voice amplification apparatus to a personal protective equipment mask, wherein the personal protective equipment mask is selected from a group consisting of a disposable N95 mask, a KN95 mask, a cloth mask, a fabric mask, a polyester mask, and a spandex mask;

the clip having a distal end and a proximal end, wherein the proximal end is attached to the enclosed case, and the distal end comprises a microphone;

the clip having a curved portion between the distal end and the proximal end, wherein the curved portion is configured to wrap around a perimeter surface of the personal protective equipment mask;

wherein the microphone is configured to receive a user's voice such that it is amplified and projected via the speaker; and, a volume control member configured to adjust the volume of the amplified voice.

* * * * *